US006516180B2

(12) United States Patent
Miyaki et al.

(10) Patent No.: US 6,516,180 B2
(45) Date of Patent: Feb. 4, 2003

(54) IMAGE FORMING APPARATUS AND CONTROL DEVICE AND METHOD THEREFOR

(75) Inventors: Makoto Miyaki, Ibaraki (JP); Hideyuki Sekiguchi, Ibaraki (JP); Akira Yasuda, Ibaraki (JP); Atsushi Kubota, Ibaraki (JP); Kazuyuki Yoshida, Ibaraki (JP); Kouji Matsuura, Kyoto (JP); Shigenori Kurokawa, Kyoto (JP); Takeshi Kakinuma, Kyoto (JP)

(73) Assignees: Riso Kagaku Corporation, Tokyo (JP); OMRON Corporation, Kyoto (JP)

( * ) Notice: Subject to any disclaimer, the term of this patent is extended or adjusted under 35 U.S.C. 154(b) by 0 days.

(21) Appl. No.: 09/966,817

(22) Filed: Sep. 28, 2001

(65) Prior Publication Data

US 2002/0061214 A1 May 23, 2002

(30) Foreign Application Priority Data

Oct. 18, 2000 (JP) ..... 2000-318264
Dec. 6, 2000 (JP) ..... 2000-370992

(51) Int. Cl.[7] ..... G03G 15/00
(52) U.S. Cl. ..... 399/396; 399/301; 399/394
(58) Field of Search ..... 271/242, 270; 399/16, 21, 301, 388, 389, 394, 396

(56) References Cited

U.S. PATENT DOCUMENTS 5,119,146 A * 6/1992 Nobumori et al. ..... 399/396
5,428,431 A * 6/1995 Abe et al. ..... 399/396
5,628,042 A * 5/1997 Less ..... 399/78

* cited by examiner

*Primary Examiner*—Hoang Ngo
(74) *Attorney, Agent, or Firm*—Beyer Weaver & Thomas LLP

(57) ABSTRACT

An image forming apparatus such as a printer and a copier has rotating devices such as a drum and a press roller to print an image on a paper sheet while rotating and a paper-transporting mechanism having guide rollers and timing rollers for transporting a paper sheet to these rotary devices, controlled by a control device such that irregularities in the printed images due to fluctuations in the speed of transportation of the paper sheets. The guide rollers may be operated to transport the paper sheet at a faster speed than the paper sheet is transported by the rotary devices such that the paper sheet becomes bent before being delivered to the rotary devices to be printed on. The control may be such that the guide rollers transport the paper sheet while the timing rollers downstream is released from the transportation of paper sheets. The control device may also operate so as to stop the guide rollers when the paper sheet comes to a position where the rotary devices can start transporting it.

11 Claims, 9 Drawing Sheets

| Conditions | | | Angle |
|---|---|---|---|
| Specification Code | Size | | θ |
| Metric | A3 | | 90° |
| | B4 | | 50° |
| | A4 | Upright | 15° |
| | | Sideways | 310° |
| | B5 | Upright | 350° |
| | | Sideways | 300° |
| Non-Metric | LT | Upright | 15° |
| | | Sideways | 310° |
| | LG | | 310° |
| | LDR | | 90° |

| Conditions | | | | Angle |
|---|---|---|---|---|
| Specification Code | Size | | Paper Quality | θ |
| Metric | A3 | | Standard | 90° |
| | | | Thick | 91° |
| | | | Thin | 89° |
| | | | Special | 92° |
| | B4 | | Standard | 50° |
| | | | Thick | 51° |
| | | | Thin | 49° |
| | | | Special | 52° |
| | A4 | Upright | Standard | 15° |
| | | | Thick | 16° |
| | | | Thin | 14° |
| | | | Special | 17° |
| | | Sideways | Standard | 310° |
| | | | Thick | 311° |
| | | | Thin | 309° |
| | | | Special | 312° |
| | B5 | Upright | Standard | 350° |
| | | | Thick | 351° |
| | | | Thin | 349° |
| | | | Special | 352° |
| | | Sideways | Standard | 300° |
| | | | Thick | 301° |
| | | | Thin | 299° |
| | | | Special | 302° |
| Non-Metric | LT | Upright | Standard | 15° |
| | | | Thick | 16° |
| | | | Thin | 14° |
| | | | Special | 17° |
| | | Sideways | Standard | 310° |
| | | | Thick | 311° |
| | | | Thin | 309° |
| | | | Special | 312° |
| | LG | | Standard | 310° |
| | | | Thick | 311° |
| | | | Thin | 309° |
| | | | Special | 312° |
| | LDR | | Standard | 90° |
| | | | Thick | 91° |
| | | | Thin | 89° |
| | | | Special | 92° |

FIG. 15

IMAGE FORMING APPARATUS AND CONTROL DEVICE AND METHOD THEREFOR

BACKGROUND OF THE INVENTION

This invention relates to an image forming apparatus and control device and method therefor, and in particular to an image forming apparatus capable of reducing irregularities in the printed images caused by the fluctuations in the speed with which sheets of paper are transported at the time of printing, as well as control device and method for such a printer. The term "image forming apparatus" as used herein will include all kinds of apparatus adapted to print an image on a paper sheet or transfer an image onto a paper sheet. In other words, ordinary printers, copiers and facsimile machines are included within the meaning of the expression.

With the recent progress in technology, it is becoming possible to make many prints at a fast rate with a printer of a relatively small size. If a printer is made smaller, however, the distance of travel by the paper sheet becomes shorter, or the length of the path between the place of paper supply and the place where the printing takes place. Thus, the printing device becomes more susceptive to the effects of transportation load in the paper supply part and the travel path of the paper sheets. Accordingly, it becomes difficult to transport a paper sheet smoothly and the speed of paper transport begins to fluctuate. This has been causing phenomena such as distortions and graduation in the image printed on such a paper sheet.

It is therefore an object of this invention to reduce the irregularities in printed images caused by the fluctuations in the speed of transport of paper sheets.

SUMMARY OF THE INVENTION

An image forming apparatus embodying this invention, which incorporates a control device of this invention for controlling its operations by a method of this invention and with which the above and other objects can be accomplished, may be characterized in most basic terms as comprising rotary devices such as a drum and a roller pressed against it for printing on a paper sheet while rotating and transporting it, a paper-transporting mechanism for transporting paper sheets one by one to the rotary devices and a control device for controlling the operation of the paper-transporting mechanism. According to a first embodiment of the invention, the control device serves to control the paper-transporting mechanism so as to transport the paper sheet at a faster speed than a slower speed by the rotary devices. As a result, there is no braking effect on the paper sheet from the paper-transmitting mechanism as it is being printed on and transported by the rotary devices and irregularities in the printed image can be prevented. The paper-transporting mechanism may include guide rollers, a motor for rotating them and a clutch for switching on and off the transmission of rotation of the motor to the guide rollers. The control device controls the operation by starting to rotate the motor before the front edge of a paper sheet reaches the rotary means and switching on the clutch when the front edge of the paper sheet does reach the rotary means. By a control of this type, the motor can be started preliminarily and hence the paper sheets can be quickly transported at a specified speed.

The paper-transporting mechanism may be described as comprising a first mechanism for transporting the paper sheet to the rotary devices and a second mechanism for transporting the paper sheet to the first mechanism, say, from a tray for preliminarily storing paper sheets. The first mechanism may comprise a pair of what is commonly referred to as the timing rollers. The second mechanism may comprise a pair of guide rollers to be driven by a motor through a clutch, as explained above regarding the first embodiment. According to a first embodiment of this invention, the second mechanism is controlled so as to transport the paper sheet not only at a faster speed than the speed of transportation by the rotary devices but also while the first mechanism is released from the transportation of the paper sheet. According to a second embodiment of the invention, the control device serves to release the second mechanism from the transportation of the paper sheet when the paper sheet comes to be in a transportable condition by the rotary devices. Instead of having a pair of guide rollers both of which are adapted to be driven by a motor, the second paper-transporting mechanism may have a driver roller driven by a motor and a follower roller which is normally pressed against the driver roller by the biasing force of a spring and a power source such as a solenoid adapted to remove the follower roller away from the driver roller, when activated. The timing of operation may be variably set according to the characteristic of the paper sheet such as its size and paper quality (such as its weight per unit surface area) such that irregularities in the printed image can be reliably prevented, independent of the type of the paper sheets being used.

BRIEF DESCRIPTION OF THE DRAWINGS

FIG. 15 is a drawing for showing the correspondence between the paper quality and the angle of rotation by the drum determining the timing for operating the solenoid.

Throughout herein, substantially like components are indicated by the same symbols for the convenience of the disclosure even if they are components of different printers and may not necessarily be explained or described repetitiously.

DETAILED DESCRIPTION OF THE INVENTION

Figure 1:
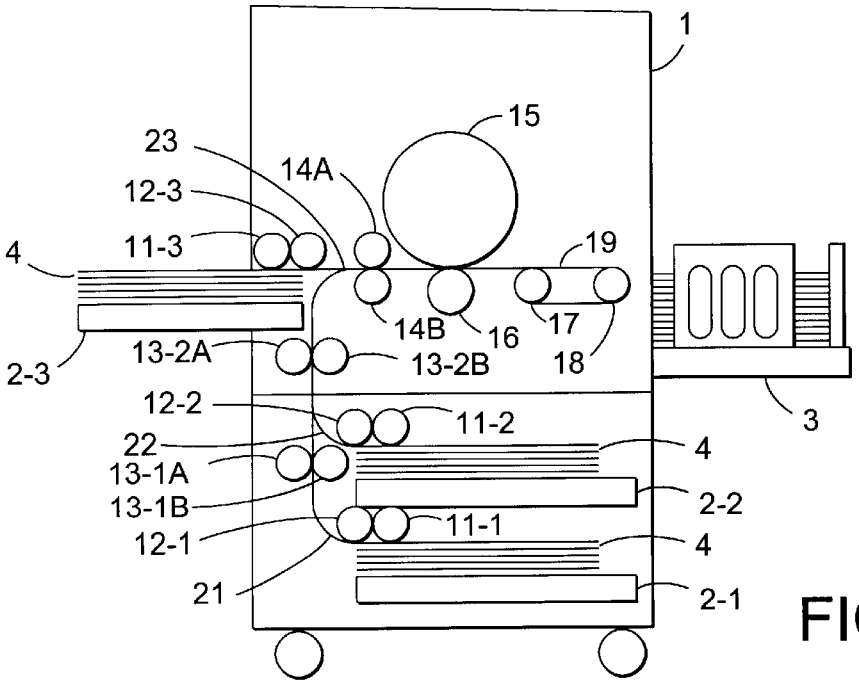
FIG. 1 is a side view of the interior of a printer embodying this invention for showing an example of its internal structure.

FIG. 1 shows an example of the structure of a printer 1 embodying this invention, adapted to supply paper sheets 4 from three different trays 2-1, 2-2 and 2-3 which may contain paper sheets of the same size or of different sizes. The paper sheets 4 in the bottom tray 2-1 are separated into individual sheets by a pair of paper supplying rollers 11-1 and 12-1 and transported successively through a travel path 21 to a pair of timing rollers 14A and 14B by means of a first pair of guide rollers 13-1A and 13-1B and a second pair of guide rollers 13-2A and 13-2B. The paper sheets 4 in the middle tray 2-2 are separated into individual sheets by another pair of paper supplying rollers 11-2 and 12-2 and transported successively through another travel path 22 to the timing rollers 14A and 14B by means of the second pair of guide rollers 13-2A and 13-2B. The portion of the paper storing and paper supplying unit including the bottom and middle trays 2-1 and 2-2, the travel paths 21 and 22 and the guide rollers 13-1A, 13-1B, 13-2A and 13-B are all disposed in the lower part of the printer 1 and may be referred to as the paper supply frame. The paper sheets 4 in the uppermost tray 2-3 are separated into individual sheets by still another pair of paper supplying rollers 11-3 and 12-3 and transported successively through still another travel path 23 to the timing rollers 14A and 14B. The timing rollers 14A and 14B are for supplying the transported paper sheet 4 to the contact point between a drum 15 and a press roller 16. The press roller 16 is adapted to be pressed against the drum 15 whenever required so as to press the paper sheet 4 delivered through the timing rollers 14A and 14B onto the drum 15 which is being rotated such that the paper sheet 4 will keep moving forward out while being printed thereon. For the convenience of description, the drum 15 and the press roller 16 are hereafter sometimes referred to as "the rotary means". The paper sheet, after being printed thereon by the drum 15, is transported out by means of a conveyor belt 19 stretched over a pair of rollers 17 and 18 and is discharged onto a discharge tray 3.

Figure 2:
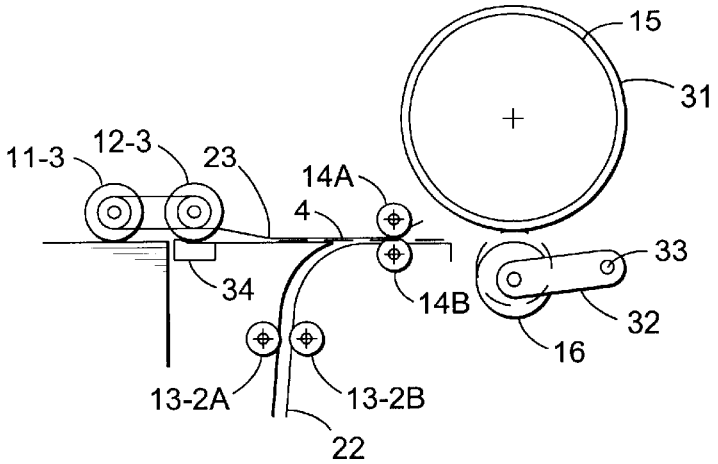
FIG. 2 is a portion of FIG. 1 for showing more in detail how a paper sheet is transported from the uppermost tray.

FIG. 2 shows more in detail how a paper sheet 4 from the uppermost tray 2-3 is delivered. Paper supplying roller 12-3 is normally in contact with a pad 34 made of a material such as rubber or resin so as to prevent two or more of the paper sheets 4 separated from the uppermost tray 2-3 from passing through at the same time as paper supplying roller 11-3 rotates. The press roller 16 is supported by an arm 32 which is rotatable around a fulcrum 33 so as to be pressed against the drum 15 (as indicated by a broken line) as the arm 32 is rotated in the clockwise direction with reference to the figure. The drum 15 has a so-called master 31 (serving as the original for the printing) set on its outer peripheral surface. As the paper sheet 4 is pressed against the rotating drum 15 by means of the press roller 16, the ink inside the drum 15 is pushed out to print an image corresponding to that on the master 31 on the paper sheet 4.

Figure 3:
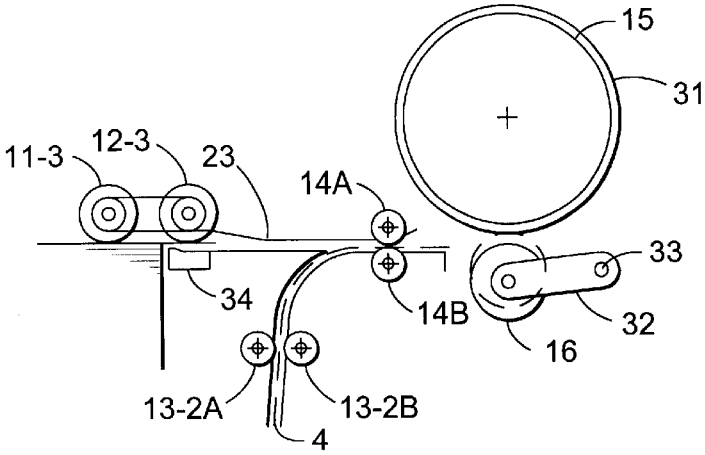
FIG. 3 is similar to FIG. 2 for showing how a paper sheet is transported from the bottom or middle tray.

FIG. 3 is a corresponding figure for showing how a paper sheet 4 is delivered from the bottom tray 2-1 or the middle tray 2-2.

Figure 4:
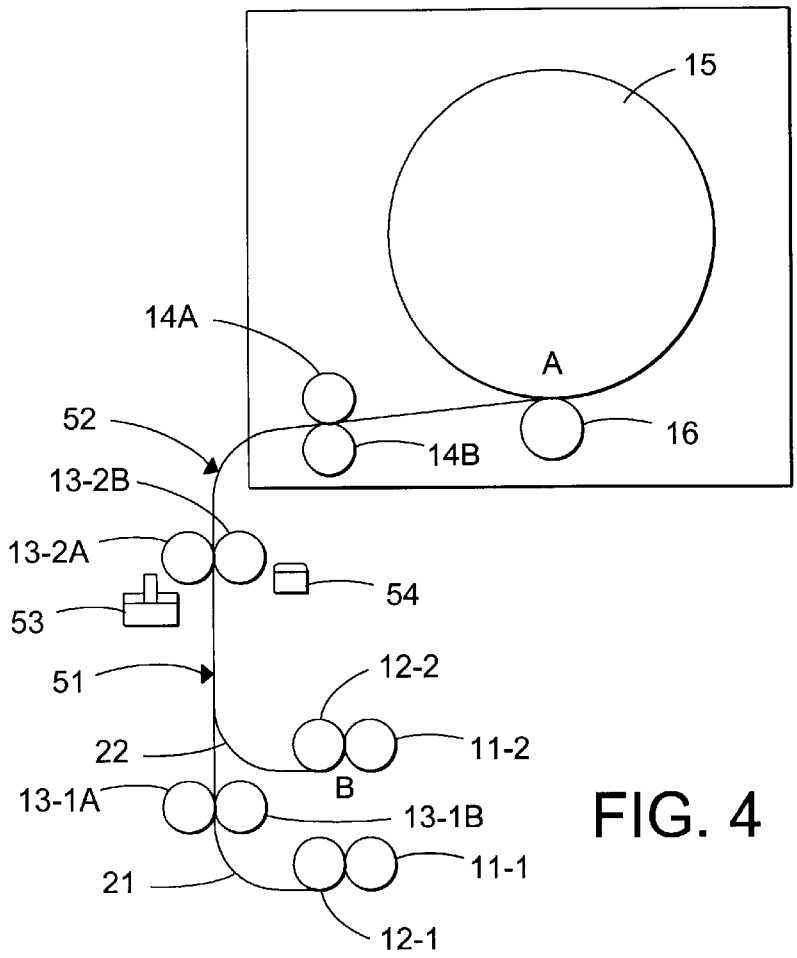
FIG. 4 is a sketch of a mechanism for transporting a paper sheet for the printer of FIG. 1.

FIG. 4 shows a mechanism according to one embodiment of the invention for controlling the speed of a paper sheet 4 when it is transported. The guide rollers 13-2A and 13-2B are rotated by a roller motor 53, there being a clutch 54 for transmitting the rotary motion of the roller motor 53 to the guide rollers 13-2A and 13-2B and stopping this transmission of motion. There is a sensor 51 disposed near the travel path 22 by the guide rollers 13-2A and 13-2B for sensing the presence of a paper sheet, like another sensor 52 which is disposed further downstream.

Figure 5:
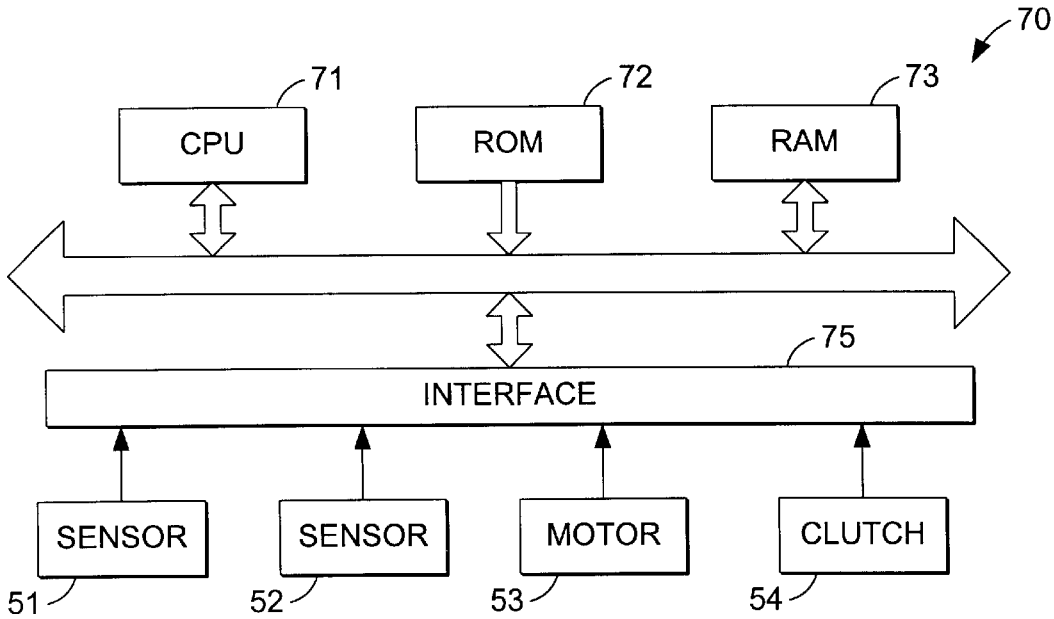
FIG. 5 is a block diagram of a control device for controlling the transportation of paper sheets for the printer of FIG. 1.

FIG. 5 shows a control device 70 for the printer 1 shown above for controlling the motion of paper sheets, comprising a CPU 71 which serves to control each component of the printer 1 according to a program stored in a ROM 72, including the components for transporting paper sheets. The program in the ROM 72 is worked sometimes by using a RAM 73, which also serves to temporarily store data for carrying various processes. The sensors 51 and 52, the roller motor 53 and the clutch 54 are connected to an interface 75 through which detection signals outputted from the sensors 51 and 52 are communicated to the CPU 71 and through which the operations of the roller motor 53 and the clutch 54 are controlled by the CPU 71.

Figure 6:
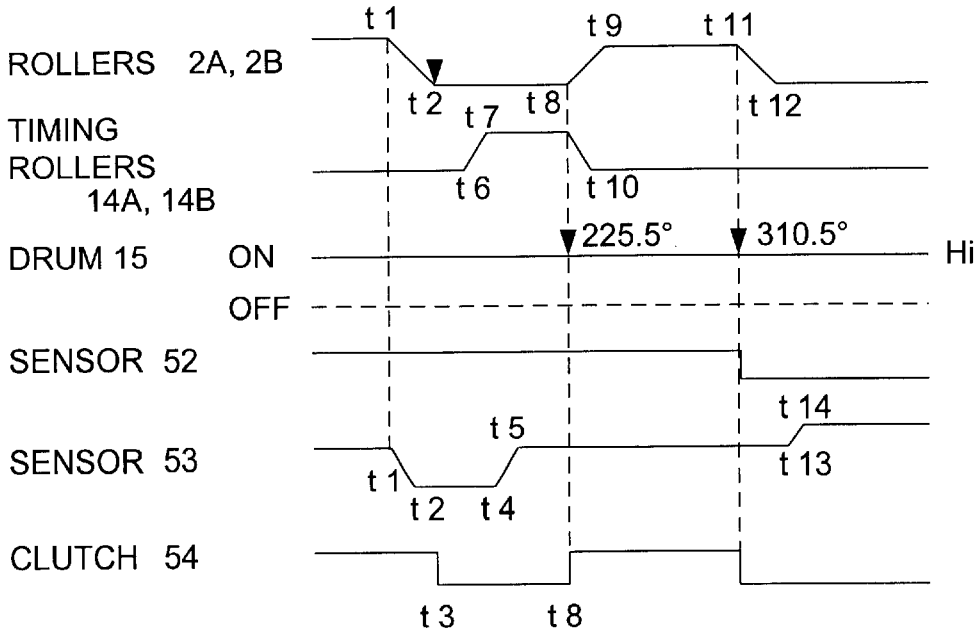
FIG. 6 is a timing chart for the control of the transportation of paper sheets for the printer of FIG. 1.

The timing chart of FIG. 6 is referenced next to explain the operation of the printer 1 thus structured. As the user delivers a command to start a printing process, the control device 70 causes the drum 15 to rotate at a specified speed and the arm 32 to rotate around the fulcrum 33 in the clockwise direction with reference to FIG. 2 or 3 so as to press the press roller 16 against the drum 15. The control device 70 also causes the timing rollers 14A and 14B to rotate and to contact each other once for each revolution of the drum 15. According to the timing shown in FIG. 6, the rotation of the timing rollers 14A and 14B is started at time $t_6$ and the speed of their rotation reaches a certain level at time $t_7$, remaining at this level until time $t_8$. As the driving of the timing rollers 14A and 14B is stopped at time $t_8$, their rotation will come to a complete stop at time $t_{10}$, and the they are moved away from each other at the same time by a mechanism not shown in the figures.

Figure 7A:
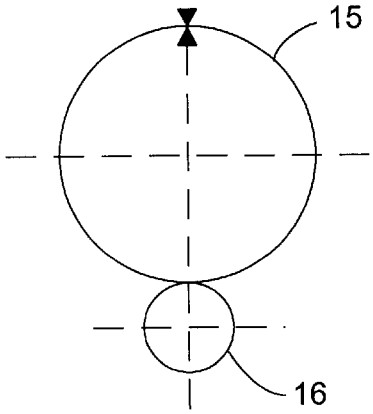
FIGS. 7A and 7B are diagrams for showing the angular positions of the drum of the printer of FIG. 1.

As the timing rollers 14A and 14B are contacted with each other at time $t_6$ and begin to rotate, the paper sheet 4 with its front edge which has been delivered to the position of the timing rollers 14A and 14B is clamped therebetween and moved forward. The front edge of this paper sheet 4 then reaches at time $t_8$ the position at which the drum 15 contacts the press roller 16. The angle θ by which the drum 15 has rotated by this moment shown in FIG. 7B from its home position shown in FIG. 7A is 225.5°. In synchronism with the rotation of the drum 15, the operation described above is repeated.

In the meantime, the control device 70 controls the delivery of the paper sheet 4 to the timing rollers 14A and 14B. The CPU 71 causes the roller motor 53 to rotate and switches on the clutch 54 such that the guide rollers 13-2A and 13-2B transport the paper sheet 4 from the tray 2-1 or 2-2, say, at a speed of 1500 mm/sec. It is up to the user to decide whether a paper sheet 4 from the bottom tray 2-1 or the middle tray 2-2 should be supplied. If it is the bottom tray 2-1 that was specified by the user, one sheet is separated out by means of the paper supplying rollers 11-1 and 12-1 and is delivered through the travel path 21 to the second pair of guide rollers 13-2A and 13-2B by means of the first pair of guide rollers 13-1A and 13-1B. If it is the middle tray 2-2 that was specified by the user, one paper sheet 4 is separated out by the paper supplying rollers 11-2 and 12-2 and is delivered through the travel path 22 to the second pair of guide rollers 13-2A and 13-2B.

The CPU 71 serves to stop driving the roller motor 53 at time $t_1$ such that the rotary motion of the roller motor 53 is completely stopped at time $t_2$. Accordingly, the speed of rotation of the guide rollers 13-2A and 13-2B begins to diminish at time $t_1$ and they completely stop rotating at time $t_2$. The timing of $t_1$ is set such that the front edge of the paper sheet 4 being delivered will reach the position of the timing rollers 14A and 14B at the same time.

Later at time $t_3$, the CPU 71 switches off the clutch 54. The clutch 54 is switched off at time $t_3$ which is later than time $t_2$ because if the clutch 54 is switched off earlier than time $t_2$, the rotary motion of the roller motor 53 will stop being communicated to the guide rollers 13-2A and 13-2B and the paper sheet 4 cannot be transported reliably to the position of the timing rollers 14A and 14B. The timing of $t_2$ is controlled so as to be reliably before $t_6$ at which the timing rollers 14A and 14B begin to rotate. It is because the timing rollers 14A and 14B will not be able to transport the paper sheet 4 if time $t_2$ is later than time $t_6$.

At time $t_4$, the CPU 71 controls the roller motor 53 and starts its rotation. The roller motor 53 reaches its specified rotary speed at time $t_5$ and continues thereafter to rotate at this constant speed. At this moment, the clutch 54 is still in the switched-off condition and hence the guide rollers 13-2A and 13-2B are still stationary. The timing of $t_5$ may be either before of after $t_6$ or $t_7$ as long as it is before $t_8$ at which the driving of the timing rollers 14A and 14B is stopped.

The driving of the timing rollers 14A and 14B is started later at time $t_6$ and they start rotating at a constant speed from time $t_7$. The paper sheet 4 is thus transported by the timing rollers 14A and 14B. At time $t_8$, the front edge of the paper sheet 4 reaches the position at which the press roller 16 and the drum 15 contact each other. As mentioned above, the angle of rotation by the drum 15 as measured from its home position at this moment is 225.5°.

Figure 8:
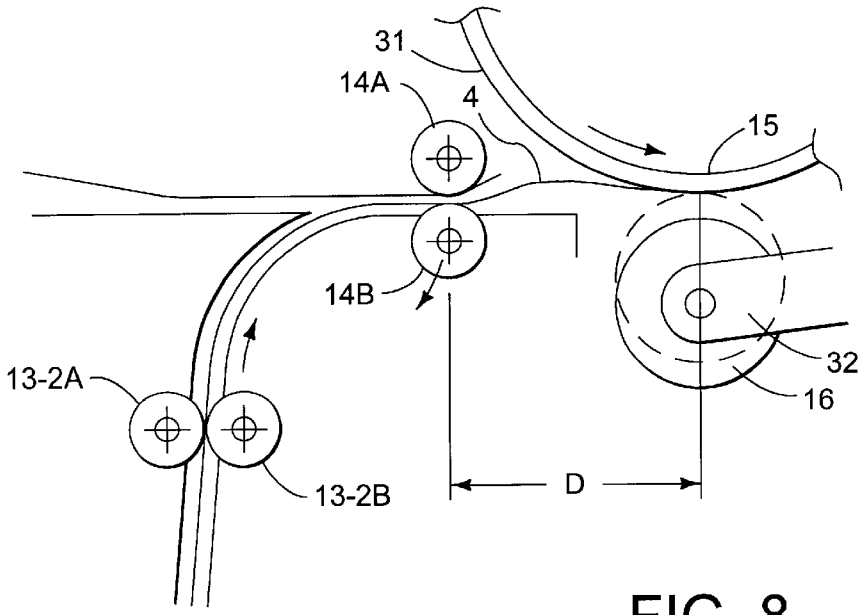
FIG. 8 is an enlarged side view of a portion of the printer of FIG. 1, showing a paper sheet in a bent condition.

The driving of the timing rollers 14A and 14B is stopped at time $t_8$ and the rotary motion of the timing rollers 14A and 14B is stopped at time $t_{10}$. As the front edge of the paper sheet 4 reaches the position of the drum 15 and the press roller 16 at time $t_8$, the CPU 71 switches on the clutch 54. The motion of the roller motor 53 is already started at time $t_4$, as explained above. Thus, this rotary motion of the roller motor 53 is communicated to the guide rollers 13-2A and 13-2B through the clutch 54. As a result, the guide rollers 13-2A and 13-2B begin to rotate, reaching a constant speed at time $t_9$. The rotational speed of the roller motor 53 at this moment is set such that the speed of transporting the paper sheet 4 by the guide rollers 13-2A and 13-2B will be somewhat faster (say, by 3%) than that by the drum 15 and the press roller 16. Because of this different in speed, the paper sheet 4 being transported ends up by being bent, as shown in FIG. 8, between the guide rollers 13-2A and 13-2B and the press roller 16, and in particularly between the timing rollers 14A and 14B and the press roller 16 in the interval indicated by letter D.

Although not shown in the figures, pads similar to the pad 34 shown in FIG. 2 are provided corresponding to the paper supplying rollers 12-1 and 12-2. Although such pads may have a braking effect on the paper sheet being transported, the aforementioned bent condition of the paper sheet reduces the possibility of such braking having any ill effects on the speed of the paper sheet 4 transported by the drum 15 and the press roller 16. In other words, irregularities in the printed image due to the fluctuations in the speed of transporting the paper sheet can be prevented.

It is logically possible to start the rotation of the guide rollers 13-2A and 13-2B at time $t_8$ without using the clutch 54 but by starting the rotation of the roller motor 53 from that moment. In reality, however, it takes a finite amount of time from the roller motor 53 to reach a specified speed. By the method described above wherein the rotation of the roller motor 53 is preliminarily started at time t4 and then the clutch 54 is later switched on at time $t_8$, it is possible to make the guide rollers 13-2A and 13-2B to rotate at the specified speed more quickly. In other words, printing at a higher speed is made possible in this manner.

Still later at time $t_{11}$ when the angular displacement of the drum 15 has become 310.5°, the sensor 52 detects the rear edge of the paper sheet 4, and the CPU 71 switches off the clutch 54. As a result, the driving of the guide rollers 13-2A and 13-2B is stopped and their rotation stops at time $t_{12}$. Still later at time $t_{13}$, the CPU 71 increases the speed of rotation of the roller motor 53 to 1500 mm/sec for printing on the next paper sheet. The speed of rotation of the roller motor 53 reaches a specified level at time $t_{14}$ and the process described above is repeated for the next and the subsequent paper sheets.

Figure 9:
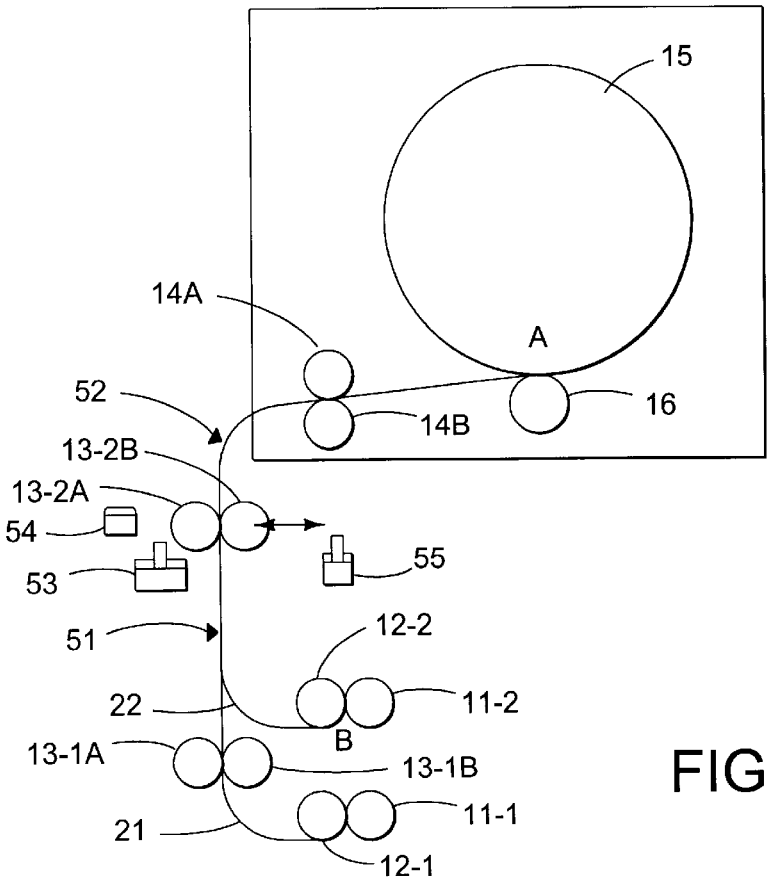
FIG. 9 is a sketch of another mechanism for transporting a paper sheet for the printer of FIG. 1.

FIG. 9 shows another mechanism according to a second embodiment of the invention for controlling the speed of a paper sheet 4 when it is transported. Since it is similar to the mechanism explained above with reference to FIG. 4, like or equivalent components are indicated by the same symbols as in FIG. 4 and may not be repetitiously explained. This mechanism shown in FIG. 9 is different from that shown in FIG. 4 firstly in that the roller motor 53 is adapted to drive only the guide roller 13-2A serving as the driver roller of the pair, that is, the clutch 54 serves to transmit the rotary motion of the roller motor 53 only to the driver guide roller 13-2A. The other guide roller 13-2B of the pair serves as a follower roller and rotates by being pressed against the driver roller 13-2A, following the rotation of the driver roller. There is additionally provided a solenoid 55 for releasing the follower roller 13-2B from its condition of being pressed against the driver roller 13-2A.

Figure 10:
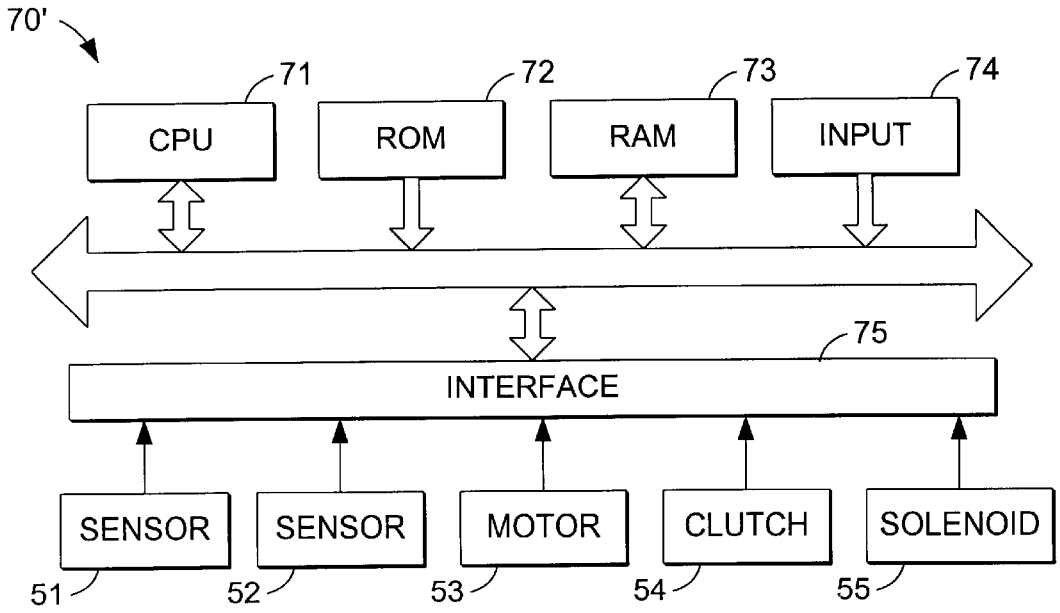
FIG. 10 is a block diagram of another control device for controlling the transportation of paper sheets for the printer of FIG. 1 with the mechanism shown in FIG. 9.

FIG. 10 shows a control device 70' for the printer 1 shown above for controlling the motion of paper sheets with the mechanism shown in FIG. 9. The control device 70' is similar to the control device 70 described above with reference to FIG. 5 except the solenoid 55 is also connected to the CPU 71 through the interface 75 such that its operation is controlled by the CPU 71. FIG. 10 also shows explicitly an input device 74 for allowing the user to operate thereon. Signals corresponding to the user's input are received by the CPU 71.

Figure 11:
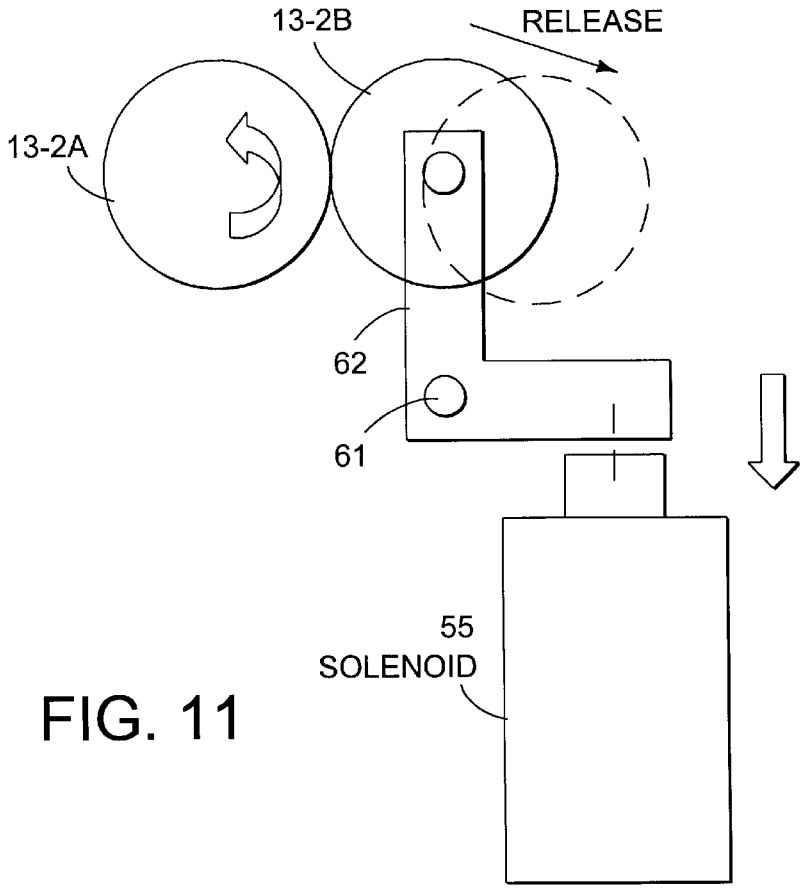
FIG. 11 is a sketch for schematically showing the operation of the solenoid of FIGS. 9 and 10.

FIG. 11 shows the operation of the solenoid 55 for releasing the follower roller 13-2B from the condition of being pressed against the driver roller 13-2A. The follower roller 12-2B is normally pressed against the driver roller 13-2A by the biasing force of a spring (shown at 106 in FIG. 16), as shown by a solid line. The follower roller 13-2B is supported rotatably at one end of a generally L-shaped link 62 which is rotatable around a fulcrum 61. The solenoid 55 is connected to the other end of this link 62. Thus, as the solenoid 55 is activated, the link 62 is rotated around the fulcrum 61 in the clockwise direction as indicated by arrows with reference to the figure, thereby moving the follower roller 13-2B away from the driver roller 13-2A, or releasing it from the condition of being pressed against it, as indicated by a broken line in FIG. 11. It now goes without saying that this mechanism as shown in FIG. 11 is not intended to limit the scope of the invention. The rotary motion of a DC motor or a stepping motor may be converted into a linear motion by means of a worm gear and a worm wheel, for example, to release the follower roller 13-2B from the driver roller 13-2A.

Figure 12:
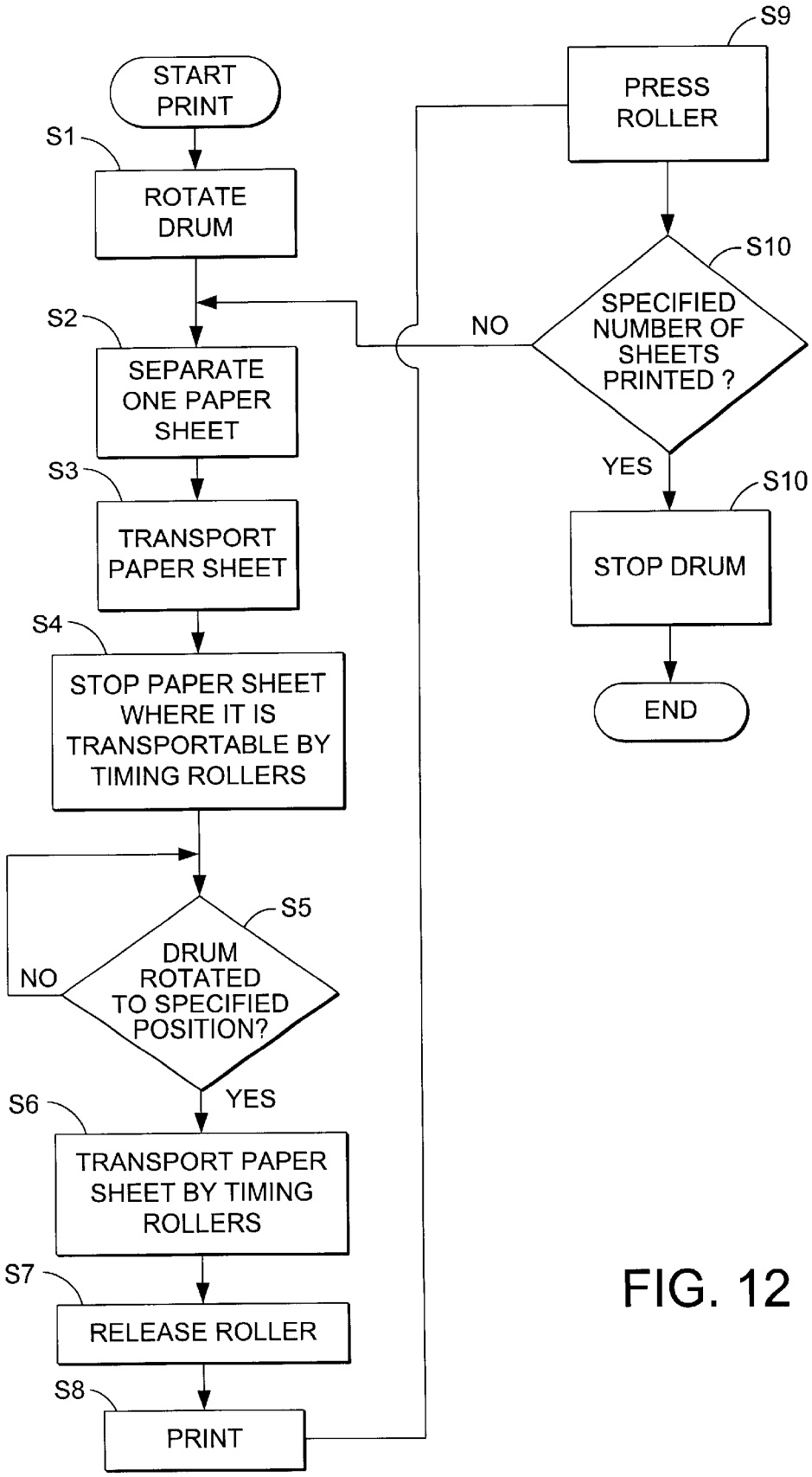
FIG. 12 is a flowchart for explaining the operation of the printer of FIG. 1.
Figures 13, 14:
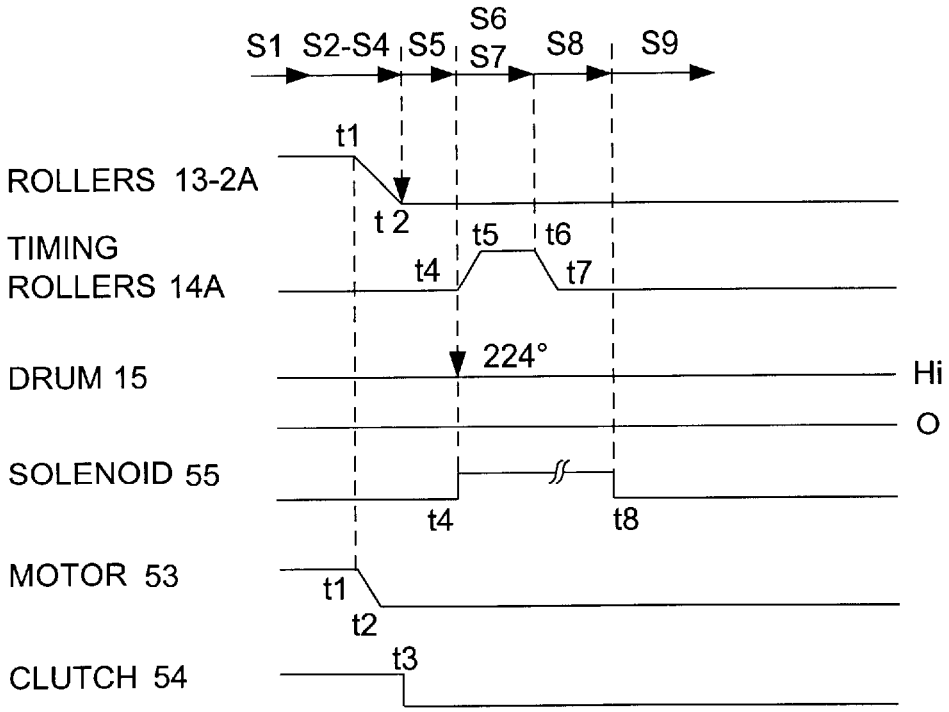
FIG. 13 is a timing chart for the control of the transportation of paper sheets for the printer of FIG. 1 with a mechanism shown in FIG. 9.
FIG. 14 is a drawing for showing the correspondence between the paper size and the angle of rotation by the drum determining the timing for operating the solenoid.

Next, the flowchart of FIG. 12 and the timing chart of FIG. 13 will be referenced to explain the. operations of the printer 1.

Figure 7B:
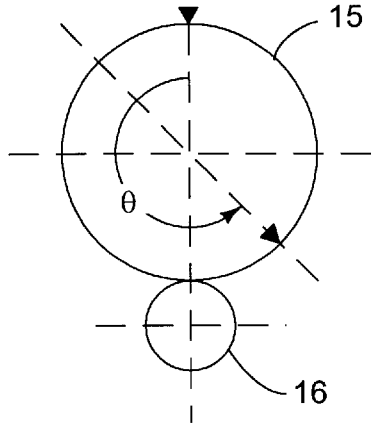

As the user places a command to start a printing operation, the control device 70' causes the drum 15 to start rotating at a specified speed and the arm 32 to rotate in the clockwise direction around the fulcrum 33 such that the press roller 16 is pressed against the drum 15 (Step S1). The operations on the timing rollers 14A and 14B are the same as described above with reference to FIG. 6 and will not be described repetitiously except that, according to the example shown in FIG. 13, the timing rollers 14A and 14B begin rotating at time $t_4$ when the drum 15 has rotated by a specified angle (say, 224°) from its home position, as shown in FIGS. 7A and 7B, beginning to be pressed against each other.

As the drum 15 rotates at a fixed speed and the press roller 16 is pressed against the drum 15, a paper sheet 4 from one of the trays 2-1, 2-2 or 2-3 selected by the user, separated as explained above (Step S2), is supplied to the timing rollers 14A and 14B. For the convenience of disclosure, it will be assumed that the user has selected the middle tray 2-2 for supplying paper sheets.

In Step S3, the CPU 71 causes the roller motor 53 to rotate and switches on the clutch 54 such that the rollers 13-2A and 13-2B transport the paper sheet 4, say, at a speed of 1500 mm/sec. In the meantime, it continues to be checked whether the paper sheet 4 has reached the position where it can be clamped between the timing rollers 14A and 14B. The transportation of the paper sheet 4 by the rollers 13-2A and 13-2B continues until it is determined that the paper sheet 4 has reached such position and then it is stopped when it becomes possible for the timing rollers 14A and 14B to clamp the front edge of the paper sheet 4 therebetween (Step S4). In FIG. 13, $t_1$ is the time at which the driving of the roller motor 53 is stopped and $t_2$ is the time when the rotation of the roller motor 53 stops completely. The timing of $t_1$ is determined such that the front edge of the paper sheet 4 will have reached the position of the timing rollers 14A and 14B. The clutch 54 is thereafter switched off at $t_3$. It has already been explained and hence will not be repetitiously explained why the clutch 54 should be switched off at $t_3$ which is later than $t_2$ and why time $t_2$ should be before time $t_4$.

In Step S5, it is checked whether the drum 15 has rotated by the specified angle (224° in this example) from its home position. When the drum 15 has rotated by this angle, the rotation of the timing rollers 14A and 14B is started (Step S6), as explained above. The CPU 71 then activates the solenoid 55 to thereby rotate the link 62 around the fulcrum 61 in the clockwise direction with reference to FIG. 11 such that the follower roller 13-2B moves away from the driver roller 13-2A (Step S7).

Thereafter, it is by the timing rollers 14A and 14B that the paper sheet 4 is transported. Since the driver roller 13-2A and the follower roller 13-2B are already separated from each other by this time, no braking force can be thereby applied on the paper sheet 4 in the direction of its travel. Thus, the paper sheet 4 is transported reliably by the force of the timing rollers 14A and 14B to the position of the drum 15 and the press roller 16.

Next, the process of printing takes place while the paper sheet 4 moves along the drum 15 while being clamped between the drum 15 and the press roller 16 (Step S8).

At time $t_8$ thereafter when the drum 15 has reached another specified angular position, the CPU 71 stops driving the solenoid 55 (Step S9), allowing the follower roller 13-2B to be pushed towards and pressed against the driver roller 13-2A by the biasing force of the spring (shown at 106 in FIG. 16) and making it possible for them to transport the next paper sheet 4. The timing $t_8$ for stopping the driving of the solenoid 55 (or the angular position θ of the drum 15) is to be adjusted according to the size of the paper sheet 4.

FIG. 14 shows an example of relationship, in the form of a table, between the size of the paper sheet 4 and the angular position θ of the drum 15 when the driving of the solenoid 55 is stopped. Such a table is preliminarily stored in the control device 70 (or 70'). In the example, θ=90° for the A3 size paper and θ=50° for the B4 size. For the A4 size paper, θ=15° if the paper is in the upright orientation and θ=310° if the paper is in the horizontal orientation (sideways). For the B5 size paper, θ=350° if the paper is in the upright orientation and θ=300° if the paper is in the horizontal orientation. For the LT size paper, θ=15° if the paper is in the upright orientation and θ=310° if the paper is in the horizontal orientation. For the LG size paper, θ=310°. For the LDR size paper, θ=90°. The size of the paper sheets is determined by the CPU 71 by receiving a command such as a specification code indicating whether the paper sheets are of a metric type or a non-metric type and the width data indicating the width of the sheets as well as an output from a length sensor set inside the paper supply frame. The advantage of varying the angle θ according to the paper size is that the solenoid 55 need not be activated over an excessively long period of time and hence the wasteful consumption of electric power thereby can be reduced. The timing for stopping the activation of the solenoid 55 need not be determined by the angle of rotation by the drum 15 but may be controlled by detecting the rear edge of the paper sheet 4 by the sensor 52 and according to the timing of this detection.

With reference back to the flowchart of FIG. 12, it is determined in Step S10 whether a preset number of paper sheets have been printed upon. If it is not, the control goes back to Step S2 and the steps thereafter are repeated. If it is determined in Step S10 that the preset number of paper sheets have been printed upon, the rotation of the drum 15 is stopped (Step S11) to terminate the printing operation.

The invention has been described above with reference to special examples only but these examples are not intended to limit the scope of the invention. Many modifications and variations are possible within the scope of the invention. For example, FIG. 15 shows another table according to which the timing for stopping the activation of the solenoid 55 is controlled by the angle of rotation of the drum 15, depending on both the size and the quality of the paper sheets. This example is different from that explained above with reference to FIG. 14 in that paper quality data indicative of the quality of the paper sheets are included. In the example of FIG. 15, the paper quality is divided into the following four categories:

(1) Standard: With area density of 64–80 g/m$^2$.

(2) Thick: With area density 80 g/m$^2$ or greater.

(3) Thin: With area density 64 g/m$^2$ or less.

(4) Special: Preliminarily specified special kind unique to the user.

Alternatively, it may be the timing of supplying the paper sheet that is to be controlled because the special kind of paper sheets selected by the user, for example, may be slippery with a small coefficient of friction such that it is easy to slip against the rollers 13-1A, 13-1B, 13-2A and 13-2B. In such a situation, the supplying of paper sheet in Steps S2-S4 in the flowchart of FIG. 12 may be started earlier by a specified length of time such that the delay in the time of arrival of the paper sheet at the position of the timing rollers 14A and 14B due to such slippage caused by the special quality of the paper may be compensated.

The driver and follower rollers 13-2A and 13-2B may not be separated, depending on the quality of the paper sheet. If the paper sheet is of a slippery quality, for example, the follower roller 13-2B may be kept pressed against the driver roller 13-2A for providing additional friction on the paper sheet. The timing chart shown in FIG. 6 substantially represents the operation in this mode and, as mentioned above with reference thereto, it is preferable to set the speed of rotation of the roller motor 53 between times $t_9$ and $t_{11}$ such that the speed of travel of the paper sheet 4 thereby will be somewhat faster (say, by 3%) than that by the drum 15 and the press roller 16. A flowchart for this mode of operation is not separately shown but may be represented as being identical to that shown in FIG. 12 except that Step S7 is replaced by the steps of transporting the paper sheet until its front edge reaches the position of the press roller and transporting the paper sheet by the rollers 13-1A, 13-1B, 13-2A and 13-2B and that Step S9 is replaced by the step of stopping the transport of the paper sheet by the rollers 131A, 13-1B, 13-2A and 13-2B.

An example of the mechanism for pressing the follower roller 13-2B against the driver roller 13-2A by activating the solenoid 55 and for releasing it from its pressed condition will be explained next more in detail with reference to FIG. 16. In this example, there is a support plate 102 which is rotatably supported by the chassis of the printer 1 around a support point 101 and to which the solenoid 55 is attached. A link 103 (corresponding to the link 62 shown in FIG. 11) is also attached to the same support plate 102 rotatably around another support point 104 (corresponding to the fulcrum 61). The follower roller 13-2B is rotatably attached to one end of the link 103. The piston (55A) of the solenoid 55 is attached to the other end of the link 103 through a connector 105. One end of a spring 106 is also affixed to the link 103 at a position proximal to the connector 105. The other end of the spring is attached to the support plate 102.

A guide plate 111 with a bent part 111A at one end is supported by the chassis rotatably around a support point 112. The left-hand side (hereinafter with reference to the figure) of the guide plate 111 is formed as a guide surface 113 for guiding paper sheets thereon. In the case of a jam, the user has only to lift the support plate 102, rotating it in the clockwise direction around the support point 101, and to remove the jamming paper. During the normal course of its use, the user rotates the support plate 102 in the counterclockwise direction around the support point 101 such that a protrusion 102A from the support plate 102 contacts and pushes the bent part 111A of the second plate 111, causing the latter to rotate in the clockwise direction around its support point 112. As the support plate 102 is locked to the chassis by a locking mechanism (not shown), the follower roller 13-2B is pressed against the driver roller 13-2A because of the biasing force of the spring 106 which causes the link 103 to rotate in the counterclockwise direction around its support point 104. In the meantime, the guide surface 113 is moved to the position capable of guiding the paper sheet being transported from the guide rollers 13-2A and 13-2B.

When the solenoid 55 is activated and its piston 55A is retracted into its main body, the connector 105 is pulled downward and the link 103 is rotated in the clockwise direction around its support point 104 against the biasing force of the spring 106, thereby causing the follower roller 13-2B to move away from and to separate from the driver roller 13-2A.

Figure 16:
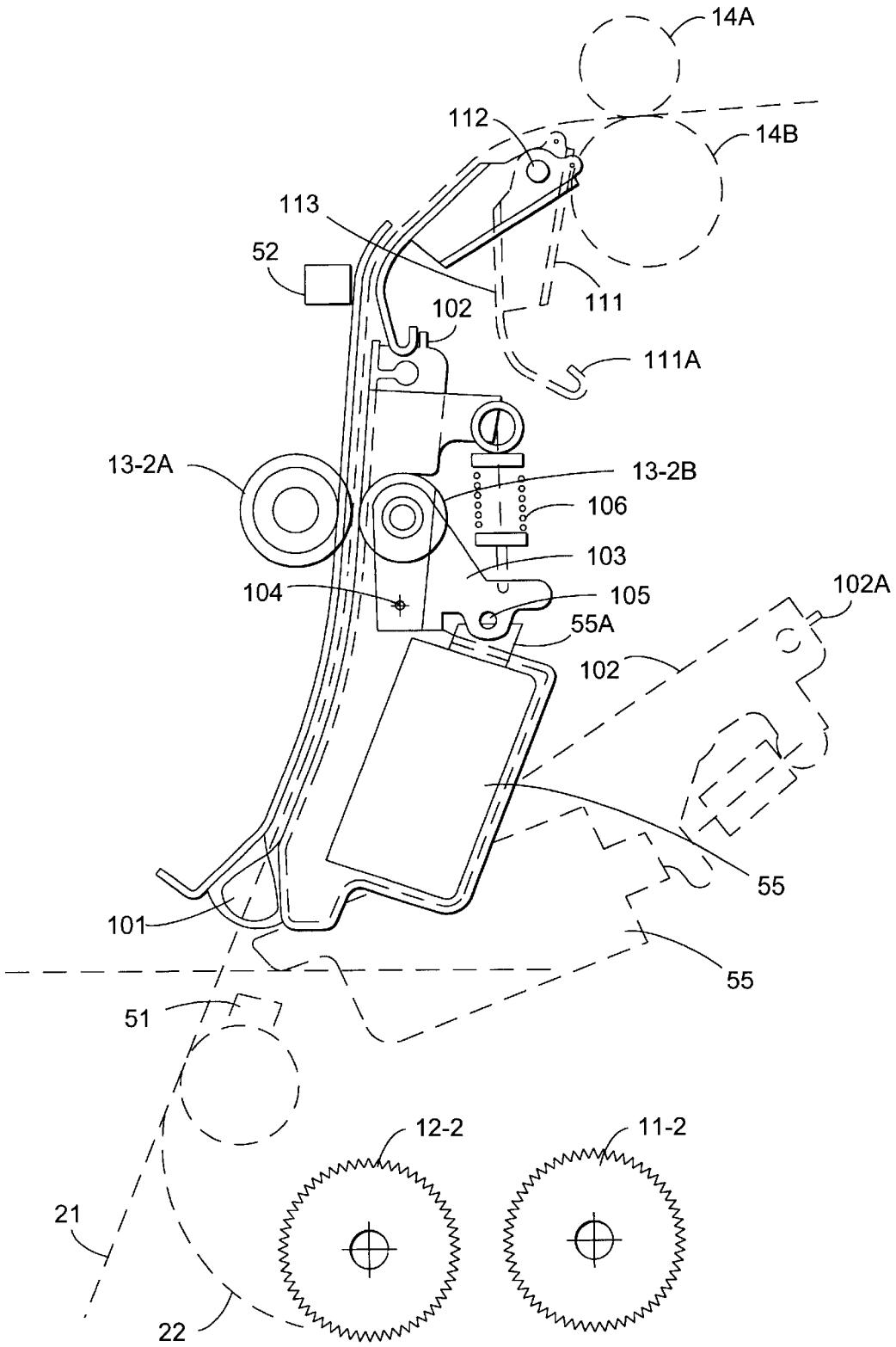
FIG. 16 is a side view of an example of mechanism for moving a follower roller of FIG. 9 towards or away from the corresponding driver roller.

Although only FIG. 16 has been referenced above to describe the mechanism controlling the second pair of guide rollers 13-2A and 13-2B, it goes without saying that the first pair of guide rollers 13-1A and 13-1B is also controlled in a similar manner. It also goes without saying that the pair of timing rollers 14A and 14B may also be controlled similarly. The control is effected on the timing rollers 14A and 14B such that no braking force will be exerted on the paper sheet being transported by the drum 15 and the press roller 16. In summary, the second embodiment of the invention makes it possible to inhibit the occurrence of irregularities in the printed image caused by the fluctuations in the speed of travel by the paper sheet because one part of the papertransporting mechanism is released from transporting a paper sheet as of the moment when the other part of the mechanism becomes ready to start transporting the paper sheet. For the convenience of further describing the invention, the part of the paper-transporting mechanism including the pair of timing rollers 14A and 14B is herein referred to as the first paper-transporting mechanism and the part of the paper-transporting mechanism including the guide rollers 13-1A, 13-1B, 13-2A and 13-2B (in the case of an image forming apparatus with three trays) or at least one pair of such guide rollers is herein referred to as the second paper-transporting mechanism.

Although the control of the speed of a paper sheet in the general direction of its travel has been described, a similar control may be effected also in the perpendicular direction. If the speeds of the both right-hand and left-end edge of a paper sheet are appropriately controlled, it is also possible to control the motion of the paper sheet such that its front edge will simultaneously cross the straight line along which the drum 15 and the press roller 16 come into contact with each other. In summary, the disclosure is intended to be interpreted as broadly as reasonable, and all modifications and variations of the disclosure that may be apparent to a person skilled in the art are intended to be within the scope of the invention.

What is claimed is:

1. An image forming apparatus comprising:

a rotary means for printing on a paper sheet while rotating;

a pressing means for pressing said paper sheet onto said rotary means;

a first paper-transporting mechanism including a pair of rollers which are pressed against each other and move away from each other for each rotation of said rotary means, said pair of rollers repetitively being pressed against each other at a first specified timing for transporting said paper sheet towards said rotary means and separating from each other to stop the transportation of said paper sheet at a specified second timing;

a second paper-transporting mechanism for repetitively transporting said paper sheet towards said first paper-transporting mechanism and stopping the transportation of said paper sheet at a specified third timing; and a control device for controlling said second paper-transporting mechanism such that said second paper-transporting mechanism transports said paper sheet towards said rotary means for a specified time at a faster speed, after a front edge of said paper sheet being transported by said first paper-transporting mechanism has reached said rotary means and the transportation of said paper sheet by said rotary means has started and when said first paper-transporting mechanism separates said pair of rollers from each other and has stopped the transportation of said paper sheet, said faster speed being faster than a slower speed with which said rotary means transports said paper sheet.

2. The image forming apparatus of claim 1 wherein said control device releases said second paper-transporting mechanism from the transportation of said paper sheet when said paper sheet comes to be in a transportable condition by said first paper-transporting mechanism.

3. The image forming apparatus of claim 2 further comprising:

a tray for preliminarily storing paper sheets therein;

separating means for separating said paper sheets preliminarily stored in said tray and successively delivering said paper sheets one at a time; and a travel path along which said second paper-transporting mechanism transports the paper sheets separated by said separating means.

4. The image forming apparatus of claim 2 wherein the release of said second paper-transporting mechanism from the transportation is effected according to the size of said paper sheet.

5. The image forming apparatus of claim 2 wherein the release of said second paper-transporting mechanism from the transportation is effected according to the weight per unit surface area of said paper sheet.

6. The image forming apparatus of claim 4 wherein the release of said second paper-transporting mechanism from the transportation is effected according to the weight per unit surface area of said paper sheet.

7. An image forming apparatus comprising:

a rotary means for printing on a paper sheet while rotating;

a pressing means for pressing said paper sheet onto said rotary means;

a first paper-transporting mechanism including a pair of rollers which are pressed against each other and move away from each other for each rotation of said rotary means, said pair of rollers repetitively being pressed against each other at a first specified timing for transporting said paper sheet towards said rotary means and separating from each other to stop the transportation of said paper sheet at a specified second timing;

a second paper-transporting mechanism for repetitively transporting said paper sheet towards said first paper-transporting mechanism and stopping the transportation of said paper sheet at a specified third timing; and a control device for controlling said second paper-transporting mechanism such that said second paper-transporting mechanism is released for a specified time from the transportation of said paper sheet, after a front edge of said paper sheet being transported by said first paper-transporting mechanism has reached said rotary means and the transportation of said paper sheet by said rotary means has started.

8. The image forming apparatus of claim 7 further comprising:

a tray for preliminarily storing paper sheets therein;

separating means for separating said paper sheets preliminarily stored in said tray and successively delivering said paper sheets one at a time; and a travel path along which said second paper-transporting mechanism transports the paper sheets separated by said separating means.

9. The image forming apparatus of claim 7 wherein the release of said second paper-transporting mechanism from the transportation is effected according to the size of said paper sheet.

10. The image forming apparatus of claim 7 wherein the release of said second paper-transporting mechanism from the transportation is effected according to the weight per unit surface area of said paper sheet.

11. The image forming apparatus of claim 9 wherein the release of said second paper-transporting mechanism from the transportation is effected according to the weight per unit surface area of said paper sheet.

* * * * *